US005121897A

United States Patent [19]

Sofy

[11] Patent Number: 5,121,897

[45] Date of Patent: Jun. 16, 1992

[54] TREE STAND HAVING IMPROVED RIB CONSTRUCTION

[75] Inventor: Hugh M. Sofy, Bloomfield Hills, Mich.

[73] Assignee: HMS Mfg. Co., Troy, Mich.

[21] Appl. No.: 713,784

[22] Filed: Jun. 12, 1991

[51] Int. Cl.[5] ..... F16M 13/00

[52] U.S. Cl. ..... 248/527; 40/40.5; 248/903

[58] Field of Search ..... 248/514, 523, 524, 527, 248/522, 526, 903, 910; 47/40.5, 39

[56] References Cited

U.S. PATENT DOCUMENTS 2,905,414 9/1959 Zierden ..... 248/527 X
4,571,881 2/1986 Lathim ..... 248/527 X
4,884,363 12/1989 Sofy ..... 248/527 X

*Primary Examiner*—Ramon O. Ramirez
*Attorney, Agent, or Firm*—Reising, Ethington, Barnard, Perry & Milton

[57] ABSTRACT

A tree stand device (10) comprises a cup-shaped receptacle (12) including an upwardly standing peripheral wall (16), a skirt (18) disposed about the exterior of the receptacle (12) and a base (22) extending downwardly and outwardly from the skirt (18). The base (22) comprises a first annular wall (24) extending radially from the skirt (18), and a second annular surface (26) having an inverted frustum shape extending outwardly from the radial outward edge of the first wall (24). A leg (28) extends downwardly from the radial outward edge of the second surface (26) and includes a an annular foot (30) extending about the periphery. The device (10) includes a plurality of secondary ribs (38) between the leg (28) and the second surface (26) equally spaced about the periphery of the base (22). A plurality of primary strengthening ribs (36) extend radially inwardly from the leg (28) between adjacent secondary ribs (38) and into the first wall (24). The primary ribs (36) terminate at a position adjacent the junction of the skirt (18) and the first wall (24).

9 Claims, 5 Drawing Sheets

TREE STAND HAVING IMPROVED RIB CONSTRUCTION

BACKGROUND OF THE INVENTION (1) Technical Field

The subject invention relates to a device for vertically supporting a tree. More specifically, the subject invention relates to a tree stand having an improved rib construction.

(2) Background Art

Tree stands are commonly used for supporting trees, e.g., Christmas trees, in a vertically upright manner. Such tree stands usually include a receptacle for receiving the base, or trunk, of a tree along with a volume of water, and some type of bracing means, e.g., thumb screws, straps, etc. for propping the tree in a vertically upright posture. The water contained in the receptacle surrounds the tree base and provides nourishment to the tree thereby prolonging its live appearance.

One such tree stand is shown in U.S. Pat. No. 4,884,363 to Sofy issued Dec. 5, 1989. The assembly generally comprises a tree stand including a cup shaped receptacle including an upwardly extending peripheral wall, a skirt disposed about the exterior of the receptacle, and a base extending outwardly and downwardly from the skirt. The base extends from the skirt at a relatively greater angle with respect to the longitudinal axis than the angle formed by the skirt and the longitudinal axis. The base comprises a first annular surface that extends from the periphery of the skirt. The base further comprises a second surface having the shape of an inverted frustum which extends from the outermost edge of the first surface. A leg extends downwardly from the second surface. With this construction, large forces imparted to the base can tend to buckle the base or cause it to fall over if the force of the tree is too great for the base to support. Although not shown in the patent, a later developed embodiment included four ribs spaced in 90 degree increments. The ribs are disposed on the bottom side of the device and extend between the leg and the second surface. One deficiency that may still arise with this type of stand is that excessive forces such as by large trees may still tend to buckle the first surface because of the relatively large angle between the first surface and the longitudinal axis.

Tree stands are also known which have skirts comprising a peripheral wall extending at a constant slope or angle from the outer surface of a receptacle to the ground. These include U.S. Pat. No. 4,571,881 to Lathim issued Feb. 25, 1986, U.S. Pat. No. 2,980,377 to Nielsen et al., issued Apr. 18, 1961 and U.S. Pat. No. 2,493,633 to Mart issued Jan. 3, 1950. Because the skirt of the devices shown in each of these patents extends at a relatively small angle relative to the longitudinal axis, the forces (particularly the vertical component) tending to buckle the skirt are more readily supported by the skirt wall. It is, however, known to add strengthening elements as shown in the '377 and '633 patents above.

Other patents showing tree stands having strengthening elements for added stability are U.S. Pat. No. 4,126,963 to Dunbar issued Nov. 28, 1978 and U.S. Pat. No. 2,337,914 to Meldrum issued Dec. 28, 1943.

Although these patents show strengthening elements having various configurations, none of them disclose a rib construction that could be used to strengthen a base assembly extending from a skirt at a greater angle relative to the longitudinal axis of the stand than the skirt.

SUMMARY OF THE INVENTION AND ADVANTAGES

According to the present invention, there is provided a tree stand device for supporting a tree in an upright posture. The device includes a receptacle defining a longitudinal axis and including an upwardly extending peripheral wall. The device further includes a skirt extending outwardly and downwardly about the exterior of the peripheral wall at a first predetermined acute angle relative to the longitudinal axis. The device further includes base means extending outwardly and downwardly from the skirt. The base means includes a first annular wall extending radially and downwardly at a flatter angle to a trough and then upwardly and outwardly through an inverted frustum shape and then downwardly to define an annular leg. The device is characterized by including a reinforcing assembly interconnecting the leg and the first wall for strengthening the base assembly.

The subject tree stand device is advantageous over the prior art tree stands by providing a skirt which extends outwardly and downwardly from the peripheral wall at a small angle so that the distance between the skirt and the peripheral wall does not increase substantially as one goes down the receptacle, and by providing a base which extends outwardly and downwardly at a large flatter angle to create a large area of support for the device. The assembly includes a plurality of primary and secondary ribs designed to provide support to the entire base assembly. Because of the large outward angle of the base, the added support of the primary ribs is necessary to prevent buckling of the base assembly, and particularly the first annular wall of the base, when large forces are imparted thereto.

Additionally, the subject tree stand is constructed for allowing like parts to be stacked or nested within one another for compact storage. The added rib design does not interfere with the stackability of the tree stands.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENTS

Figure 1:
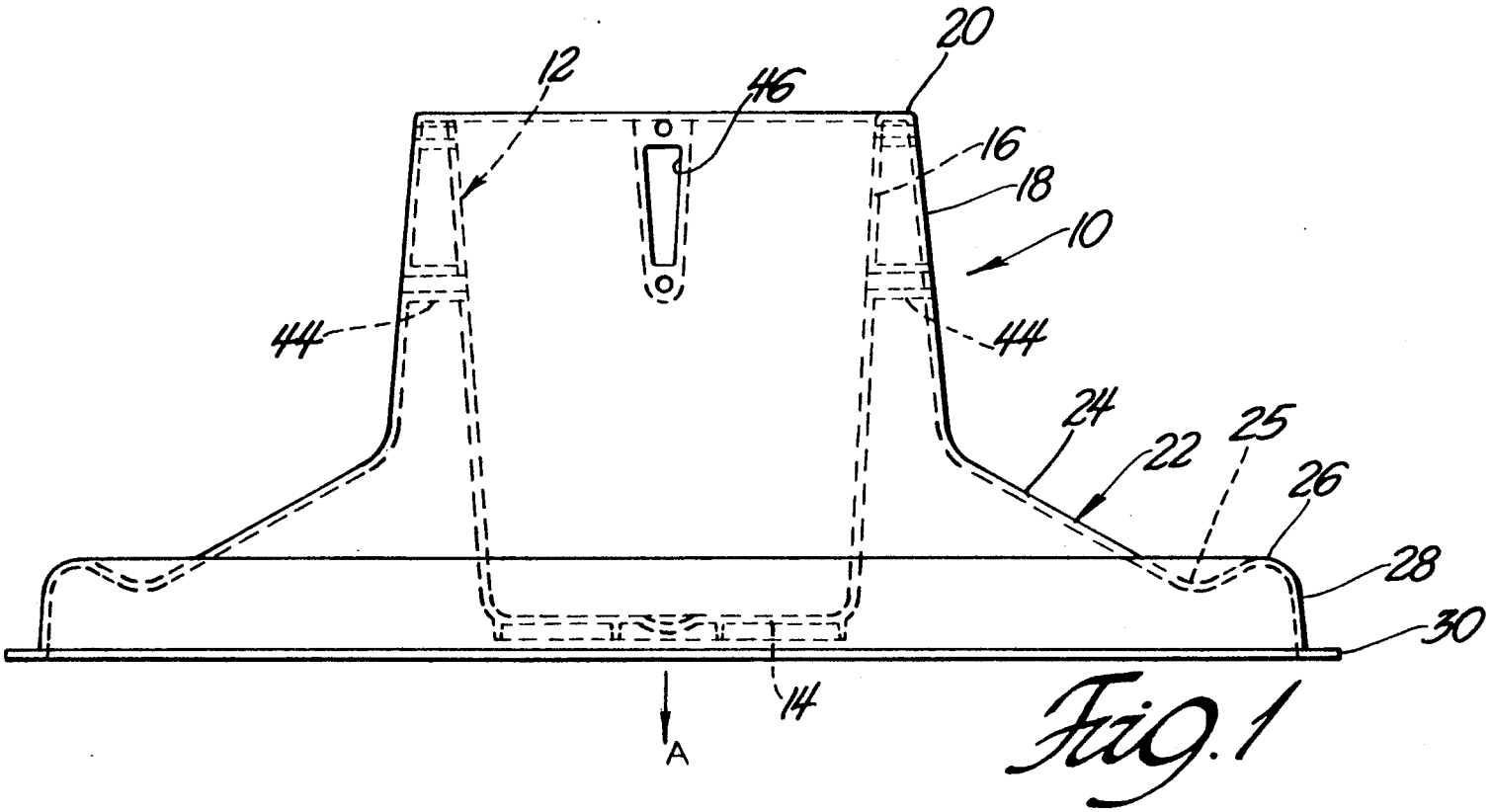
FIG. 1 is a front view of the subject invention.

Referring to the Figures, wherein like numerals indicate like or corresponding parts throughout the several views, the subject tree stand device for supporting a tree in an upright posture is generally shown at 10. The tree stand 10 is generally symmetrical about a vertical axis A, and includes a receptacle generally indicated at 12, for receiving a tree and a volume of liquid. The base, or trunk, of the tree is shown in phantom at 13 in FIG. 2.

The receptacle 12 is cup-shaped for containing a liquid, e.g., water, and for surrounding the base or trunk 13 of a tree disposed therein so that the tree is supported above a support surface, e.g., a floor, a table, etc., in an upright posture. The receptacle 12 comprises a disk like bottom end 14 and a peripheral wall 16. The peripheral wall 16 extends upwardly from the bottom end 14. In other words, the wall 16 and the bottom end 14 define the cup-shape of the receptacle 12.

A skirt 18 extends outwardly and downwardly about the exterior of the peripheral wall 16. An annular connecting portion 20 is disposed at the uppermost edge of the peripheral wall 16, and extends between the receptacle 12 and skirt 18 to connect the two pieces together. In other words, the skirt 18 is connected to the peripheral wall 16 by the annular connecting portion 20.

The device 10 further .includes a base means or assembly generally indicated at 22. The base assembly 22 extends outwardly and downwardly from the skirt 18, and has a greater outward projection than the skirt 18 for providing a large area of support to the device 10. Said another way, the outward slope of the base assembly 22, relative to the vertical axis A, is significantly greater or flatter than the frustum slope of the skirt 18 (i.e. the shape of the skirt relative to the vertical axis A). In the preferred embodiment wherein the tree stand 10 is symmetrical about the axis A, the base assembly 22 has a frustum slope that extends radially outwardly from the vertical axis A a substantial distance thereby providing a high resistance to overturning, or tipping. This defiance to tippage is particularly advantageous when a tall tree is supported in the tree stand 10, whereby the tree would otherwise create a great amount of leverage (i.e. a large moment) with which to overturn the device 10.

The base assembly 22 comprises a first annular surface or wall 24 which extends from the lower periphery of the skirt 18. The base assembly 22 further includes a second annular surface 26 having an inverted frustum shape, i.e. extending outwardly and upwardly from the radially outward edge of the first wall 24 to define an annular trough 25. The annular trough 25 is specifically adapted for capturing overflow liquid from the receptacle 12, thereby preventing leakage of the liquid onto the support surface, which would otherwise soil the support surface and possibly cause damage. Also, the base assembly 22 includes a leg 28 which extends downwardly from the radial outward edge of the second surface 26.

In other words, the base assembly 22 comprises the first annular wall 24 extending radially and downwardly at a flatter angle from the skirt 18 to the trough 25 and then upwardly and outwardly through the inverted frustum shape 2 and then downwardly to define the annular leg 28.

Figure 4:
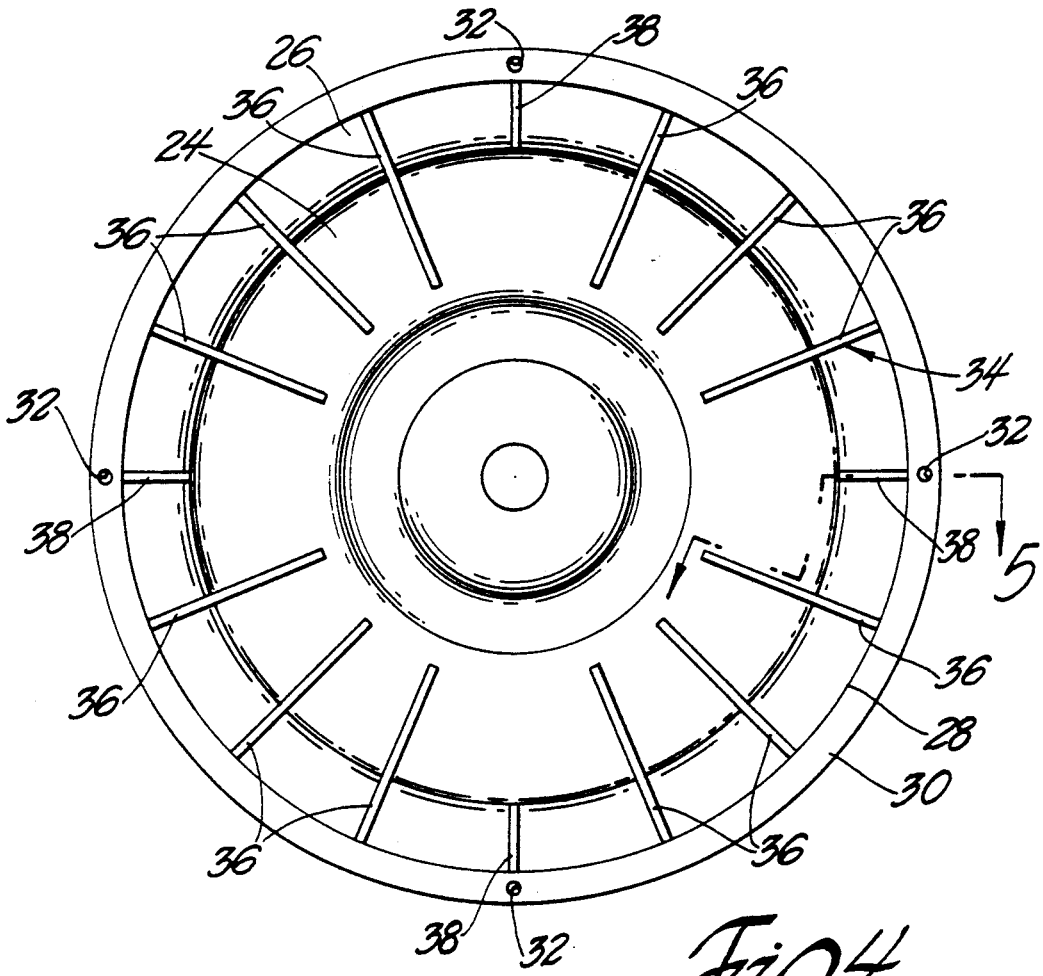
FIG. 4 is a bottom view of the subject invention.
Figure 5:
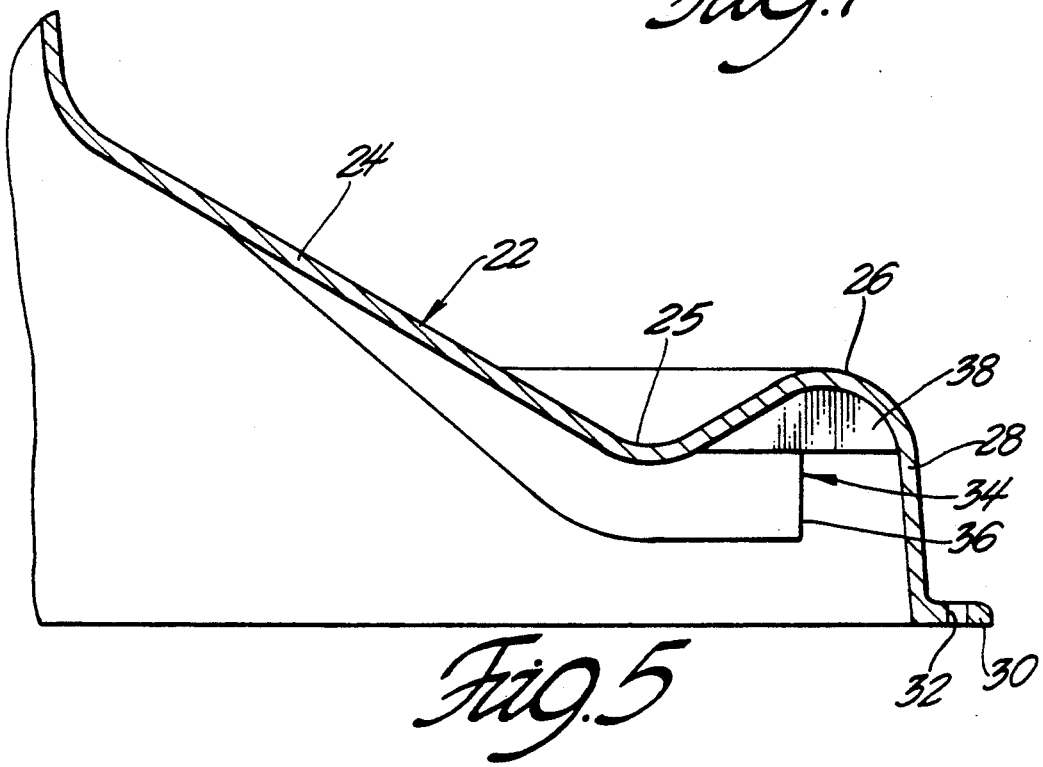
FIG. 5 is a cross-sectional view partially broken away taken along lines 5—5 of FIG. 4.

The base assembly 22 further includes an annular foot 30 extending about the lower periphery of the leg 28. The annular foot 30 provides a contact with the support surface at an extreme radial displacement from the central axis A, thereby furnishing a high resistance to tippage. To further aid resistance to tippage, the annular foot 30 has a plurality of securement holes 32 therethrough. As best seen in FIGS. 4 and 5, the securement holes extend through the annular foot 30 in the direction of the longitudinal axis A. Further, in the preferred embodiment, the securement holes are spaced by about 90 degrees with respect to the longitudinal axis. That is, the annular foot 30 includes four of the securement holes 32 each offset or spaced by about 90 degrees with respect to the longitudinal axis A. The securement holes 32 are for receiving fastening elements, i.e., nails, screws, etc, to secure the device 10 with the support surface. The fastening elements help prevent tipping of the device 10.

The base assembly 22 further includes a reinforcing means or assembly generally indicated at 34. The reinforcing assembly 34 interconnects the leg 28 and the first wall 24 for strengthening the base assembly 22. More specifically, the reinforcing assembly is fixedly secured to each of the first annular surface 24, the second annular surface or inverted frustum shape 26, and the leg 28 for strengthening the base assembly 22. Because of the relatively large acute angle with which the first annular wall 24 extends with respect to the longitudinal axis A, high forces having large vertical components, components in the direction of the longitudinal axis A, may tend to buckle the first annular wall 24. The reinforcing assembly 34 is adapted to aid in supporting the entire base assembly 22 and particularly the first annular wall 24.

Figure 3:
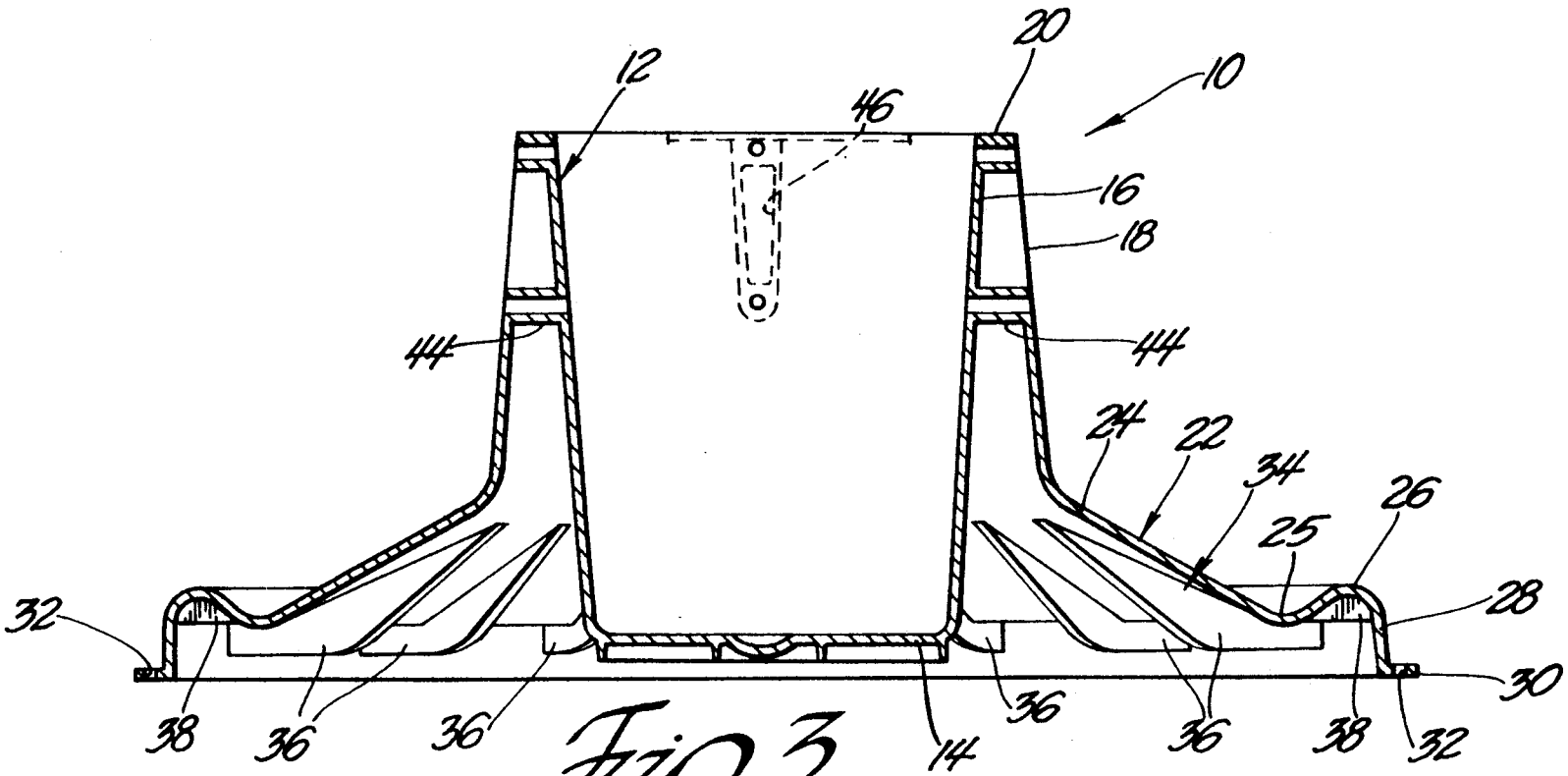
FIG. 3 is a cross-sectional view of the subject invention.
Figure 6:
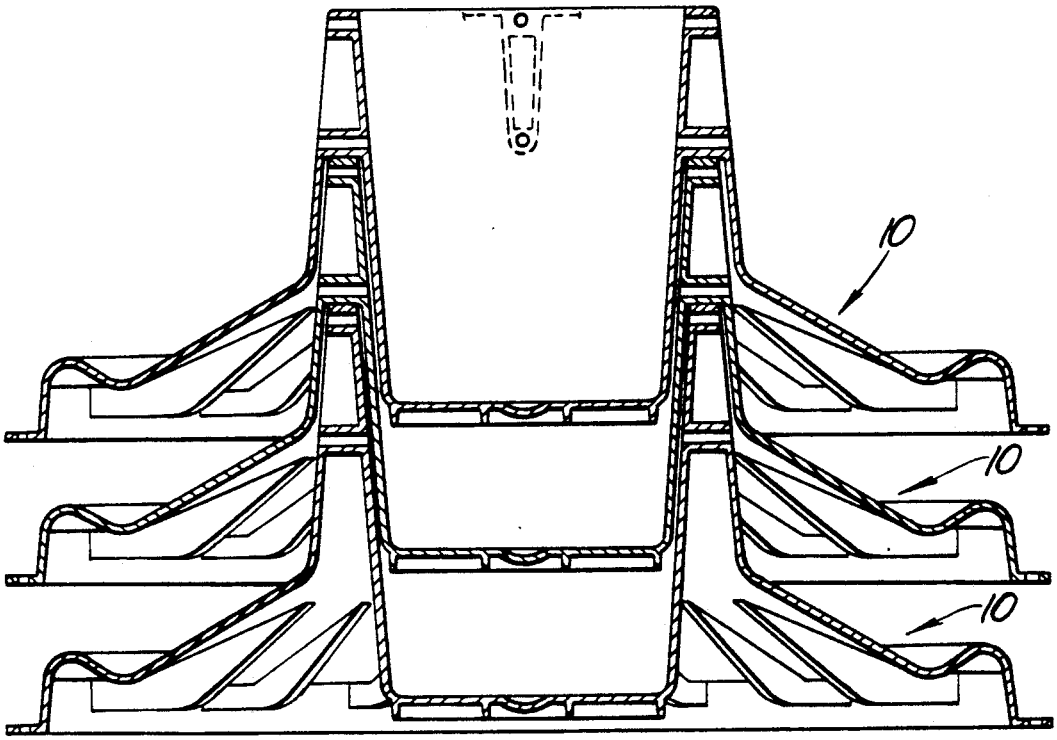
FIG. 6 is a cross-sectional view of three individual tree stands of the subject invention vertically stacked and nested for compact storage.

As best shown in FIGS. 3, 4 and 5, the reinforcing assembly 34 firstly includes a plurality of primary ribs 36 fixedly secured to the annular leg 28, second annular surface or inverted frustum shape 26, and first annular wall 24. As shown, the ribs 36 are located on the bottom or underside of the device 10. Each of the ribs 36 extends from the leg 28 radially inwardly toward the longitudinal axis. In the area of the second surface 26, the height of each of the ribs 36 is at its greatest. As the rib 36 extends further inwardly, i.e. toward the longitudinal axis A, the rib converges to terminate on the first wall 24 adjacent the junction of the skirt 18 with the first wall 24. It is important that the ribs 36 terminate at a point spaced from the connection of the first annular wall 24 with the skirt 18 to allow sufficient strengthening of the base 22 without impeding the stackability of the devices (FIG. 6). That is, if the ribs 36 extended the entire length of the first annular wall 24 and past the point of connection with the skirt 18, the devices 10 would not be easily stackable with one another.

The reinforcing assembly 34 further includes a plurality of secondary strengthening ribs 38. As best viewed in FIGS. 4 and 5, the secondary strengthening ribs 38 extend from the leg 28 radially inwardly toward the longitudinal axis A and terminate at the second annular surface 26. Thus, the strengthening elements 38 interconnect only to the leg 28 and the second surface or inverted frustum shape 26.

As best viewed in FIGS. 4 and 5, the arrangement of the secondary strengthening ribs 38 and the primary ribs 36 about the base assembly 22 is as follows. The assembly includes four secondary ribs 38 each spaced by about 90 degrees with respect to the longitudinal axis A. That is, each of the secondary ribs 38 are offset from one another by approximately 90 degrees with respect to the longitudinal axis A. A plurality of the primary ribs 36 are disposed between adjacent of the secondary ribs 38. As shown, it is preferred that three primary ribs 36 are equally spaced between adjacent of the secondary ribs 38. Thus, in the completed configuration as shown in FIG. 4, there are four secondary ribs 38, each of the secondary ribs 38 equally spaced about the periphery of the base assembly 22. Between each adjacent of the secondary ribs 38 are three primary ribs 36, for a total of twelve primary ribs 36, equally spaced. This configuration of primary ribs 36, and secondary ribs 38, allows for sufficient strength to be added to the entire base assembly 22 to prevent buckling of the base assembly 22, and particularly the first annular surface 24, while maintaining the desirable quality that the devices 10 can be stacked together (FIG. 6). It will be appreciated that each of the secondary ribs may be eliminated if desired. Further, each of the secondary ribs 38 may be replaced by a primary rib 36.

The tree stand 10 further includes bolt means 40 extending inwardly through the skirt 18 and peripheral walls 16 of the receptacle 12 for releaseably engaging the tree trunk 13. Preferably, the bolt means 40 comprise four pairs of vertically spaced bolts arranged in equal radial increments about the receptacle 12. In other words, eight bolt means 40 are disposed in 90 degree increments about the receptacle 12 in pairs of vertically spaced upper and lower threaded bolts.

Alternatively, the vertically spaced bolt means 40 may be arranged in a staggered relationship about the periphery of the receptacle 12. That is, rather than having the bolt means 40 disposed one over the other as shown, the upper most and lower most bolt means 40 may be angularly offset from one another. What is important is that there are two sets of bolt means 40, one set at a relatively higher position than the other with respect to the peripheral wall 16 of the receptacle 12. Angular orientation of the two sets of bolt means 40 (uppermost and lowermost) with respect to one another is not important. However, the bolt means 40 should be spaced at equal angular increments.

Figure 2:
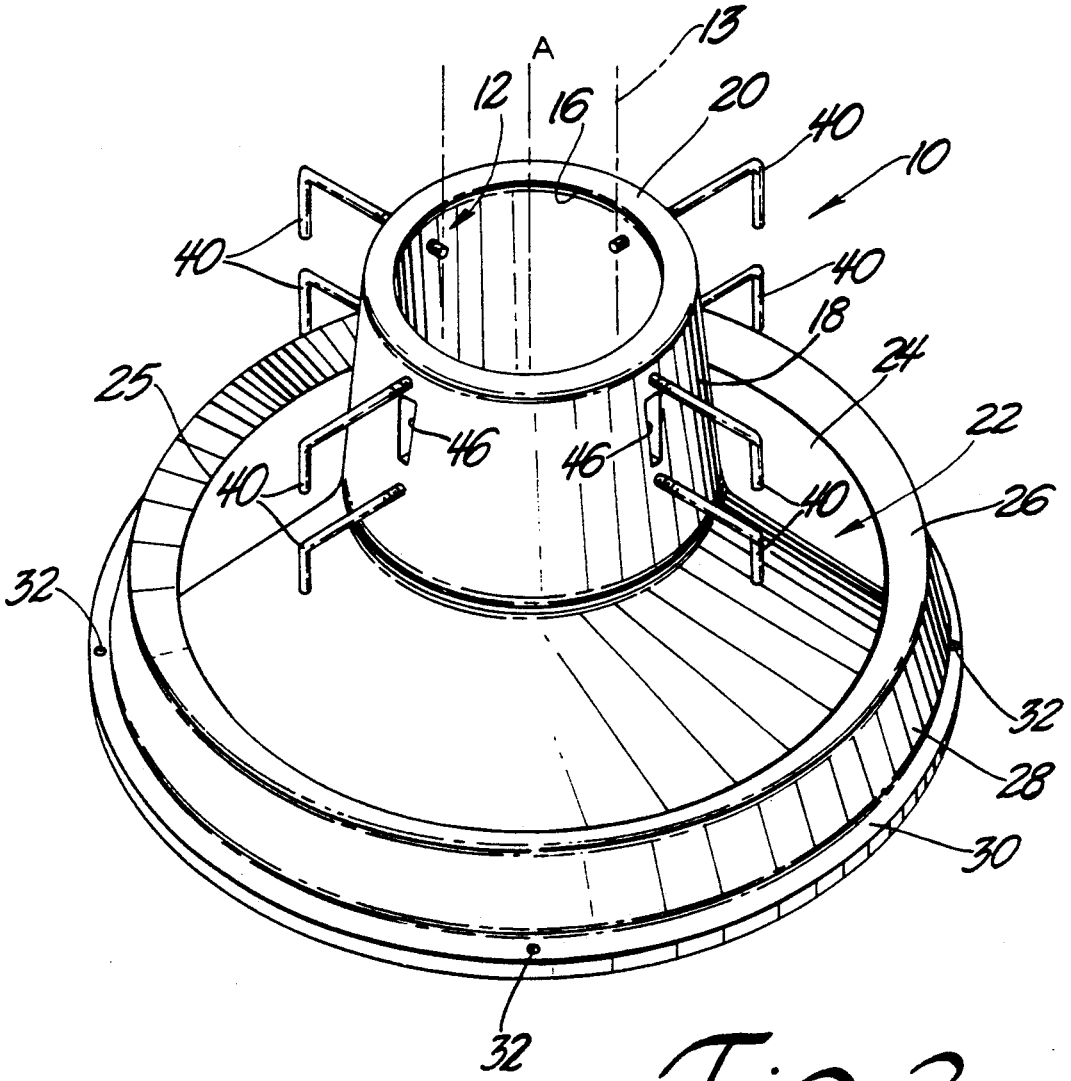
FIG. 2 is a perspective view of the subject invention.

As shown in FIG. 2, the bolt means 40 may be L-shaped to better allow an individual to grip and twist the bolt means 40 through the receptacle 12 to press against the tree trunk 13. Alternatively, the bolt means 40 may have a loop or eyelet on the end thereof for receiving a twisting force from one's hand or perhaps a tool.

The angle between the peripheral wall 16 and the skirt 18 is relatively small, so that the distance between the two remains substantially the same. In other words, the narrow angle between the peripheral wall 16 and the skirt 18 ensures that the skirt 18 does not diverge from the peripheral wall 16 a significant distance. This is of particular concern when vertically spaced pairs of bolt means 40 extend through the skirt 18 and the peripheral wall 16, so that the lower most bolt means 40 do not have to be of great length to span the distance between the skirt 18 and the peripheral wall 16.

The base assembly 22 may join the skirt 18 at any location below the lower most bolt means 40, so as not to defeat the purpose of the narrowly spaced skirt 18 and peripheral wall 16. In this manner, the overall height of the tree stand 10 may be varied by altering the skirt 18 height, or base assembly 22 height or frustum slope.

As shown in all of the Figures, the receptacle 12, skirt 18, first annular wall 24, second annular surface 26, leg 28, annular foot 30, primary ribs 36, and secondary ribs 38 are of a one-piece integral construction. Preferably, the tree stand 10 is manufactured from an injection molded plastic material.

As perhaps best shown in FIG. 2, the peripheral wall 16 of the receptacle 12 has an inverted frustum shape allowing one tree stand 10 to nest with another tree stand 10. The frustum shape of the skirt 18 and the inverted frustum shape of the receptacle 12 enable one tree stand 10 to nest within another in a vertically stacked orientation, as shown in FIG. 6. The nesting of the devices is particularly advantageous in the storing and transportation of mass quantities of tree stands, as valuable space can be conserved. The frustum shape of the first wall 24, inverted frustum shape of the second surface 26, and the leg 28 may further cooperated with the nesting of one tree stand 10 with another, if so desired.

The tree stand 10 may include webs 44 extending between the peripheral wall 16 of the receptacle 12 and the skirt 18 and surrounding each pair of vertically spaced bolt means 40 for reinforcing the bolt means 40 extending therethrough. As best shown in FIGS. 1 and 3, four webs 44 are disposed about the receptacle 12 in equally spaced radial increments, i.e., 90 degree increments to reinforce two vertically spaced bolt means 40. Said another way, each web 44 extends between and supports the pair of two vertically spaced bolt means 40, the uppermost bolt means 40 being disposed near the uppermost edge of the receptacle 12 and the lower most bolt means 40 spaced vertically below the first bolt means 40.

It will be appreciated that any means of supporting the bolt means 40 in the skirt 18 and peripheral wall 16 can be used. For example, the skirt 18 or peripheral wall 16 may have a retainer for receiving a speed nut If this design is used, the bolt means 40 can simply be pushed through the speed nut in one direction, by exerting an axial force onto the bolt means 40, until it engages the trunk 13. To further tighten or remove the bolt means 40, the bolt means 40 is rotated and behaves in a normal threaded manner.

The webs 44 each include a vertically elongated cavity 46 disposed between each pair of vertically spaced bolt means 40 and extending radially outwardly from adjacent the exterior surface of the peripheral wall 16 through the exterior surface of the skirt 18. Stated another way, the cavities 46, as perhaps best shown in FIG. 1, are disposed through the skirt 18 and extend up to but not through the peripheral wall 16 and the receptacle 12. The purpose of the cavity 46 is to prevent needless waste of web 44 material since only a portion of the web 44 surrounding the bolt means 40 is needed to effectively provide reinforcement.

A tree, such as a Christmas tree, is vertically supported in the device 10 by positioning the base or trunk 13 of the tree in the receptacle 12 so that the bottom of the tree rests on the receptacle disk like bottom end 14, or the lower most branches rest on the annular connecting portion 20. The bolt means 40 are then individually placed into pressing engagement with the base, or trunk 13 of the tree to vertically prop the tree in an upright posture. Should the tree base or trunk 13 be crooked or non-uniform in some manner, the vertically spaced pairs of bolt means 40 are individually adjusted to engage the base or trunk 13 of the tree in multiple, vertically spaced locations for ensuring that the tree is propped in a vertical upright posture.

The tree stand device 10 is particularly well adapted for mass storage by vertically stacking one tree stand device 10 upon another such that the like devices compactly nest together, as is best shown in FIG. 6. As will be appreciated, the bolt means 40 must be removed prior to stacking. The amount of distance between stacked tree stand devices 10 is dependant upon such variables as web 44 length, receptacle 12, and skirt 18 frustum slope, leg 28 length, etc. In the preferred embodiment, the bottom of the web portions 44 of the nested tree stands 10 rests on the annular connecting portion 20 of a lower tree stand 10. In this manner, a space is provided between the inner and outer surfaces of the adjacent skirt 18 which facilitates separating nested tree stand devices 10. That is to say, annular connecting portion 20 is adapted to support another like tree stand device 10 when in nested relationship, to allow a space to exist between the adjacent skirts 18. This prevents either a suction build up or a friction force fit from making separation difficult. It is also noted that the ribs 36 do not interfere with the stacking of the devices 10.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A tree stand device (10) for supporting a tree (13) in an upright posture, said device (10) comprising:

a receptacle (12) defining a longitudinal axis (A) and including an upwardly extending peripheral wall (16);

a skirt (18) extending outwardly and downwardly about the exterior of said peripheral wall (16) at a first predetermined acute angle relative to said longitudinal axis (A);

base means (22) extending outwardly and downwardly from said skirt (18) and comprising a first annular wall (24) extending radially and downwardly at a flatter angle from said skirt (18) to a trough (25) and then upwardly and outwardly through an inverted frustum shape (26) and then downwardly to define an annular leg (28);

said device (10) characterized by including reinforcing means (34) interconnecting said leg (28) and said first wall (24) for strengthening said base means (22).

2. A device as set forth in claim 1 further characterized by said reinforcing means (34) being also connected to said frustum shape (26).

3. A device as set forth in claim 2 further characterized by said reinforcing means (34) comprising a plurality of ribs (36) each extending radially inwardly from said leg (28) toward said longitudinal axis (A).

4. A device as set forth in claim 3 further characterized by each of said ribs (36) converging on said first annular wall (24) to terminate adjacent the junction of said skirt (18) with said first annular wall (24).

5. A device as set forth in claim 4 further characterized by including a plurality of secondary strengthening ribs (38) interconnecting only said leg (28) and said frustum shape (26), a plurality of said ribs (36) disposed between adjacent of said secondary ribs (38).

6. A device as set forth in claim 3 further characterized by said base means (22) further comprising a radially extending annular foot (30) disposed about said leg (28).

7. A device as set forth in claim 6 further characterized by said annular foot (30) having at least one securement hole (32) therethrough, said securement hole (32) extending through said foot (30) in the direction of said longitudinal axis (A).

8. A device as set forth in claim 7 further characterized by said annular foot (30) having four of said securement holes (32) therethrough, each of said securement holes (34) spaced by about 90 degrees with respect to said longitudinal axis (A).

9. A device a set forth in claim 7 further characterized by said tree stand device comprising an integral construction.

* * * * *